US006166659A

United States Patent [19]

Kusano

[11] Patent Number: 6,166,659

[45] Date of Patent: Dec. 26, 2000

[54] TOLL COLLECTING SYSTEM AND METHOD INCLUDING DETERMINATION OF A TOWED VEHICLE

[75] Inventor: Atsushi Kusano, Kanagawa-ken, Japan

[73] Assignee: Kabushiki Kaisha Toshiba, Kawasaki, Japan

[21] Appl. No.: 09/518,725

[22] Filed: Mar. 3, 2000

[30] Foreign Application Priority Data

Mar. 3, 1999 [JP] Japan ..... 11-055550

[51] Int. Cl.[7] ..... G08G 1/065

[52] U.S. Cl. ..... 340/928; 340/937; 340/942; 340/943; 235/384

[58] Field of Search ..... 340/928, 937, 340/942, 943; 382/104, 105; 705/13; 235/384

[56] References Cited

U.S. PATENT DOCUMENTS

| | | | |
|---|---|---|---|
| 5,602,375 | 2/1997 | Sunahara et al. | 235/384 |
| 5,777,565 | 7/1998 | Hayashi et al. | 340/928 |
| 5,825,007 | 10/1998 | Jesadanont | 235/384 |
| 5,872,525 | 2/1999 | Fukasawa et al. | 340/928 |
| 5,955,970 | 9/1999 | Ando et al. | 340/928 |
| 5,995,018 | 11/1999 | Hane et al. | 340/825.54 |
| 6,034,625 | 3/2000 | Mitsuno | 340/937 |
| 6,040,785 | 3/2000 | Park et al. | 340/928 |
| 6,042,008 | 3/2000 | Ando et al. | 235/384 |

*Primary Examiner*—Daniel J. Wu
*Assistant Examiner*—Phung Nguyen
*Attorney, Agent, or Firm*—Pillsbury Madison & Sutro LLP

[57] ABSTRACT

The toll collecting system includes a first detector and a second detector which are sequentially arranged in the moving direction of vehicles passing on the traffic lane for collecting charges and detect a passing first vehicle and a second vehicle moving behind the first vehicle respectively, a roadside antenna and an antenna controller for carrying out radio communication between the detector and the first vehicle passing on the traffic lane and between the detector and the second vehicle respectively and obtaining information such as a vehicle kind and a vehicle number, a camera for taking a photograph of the number plate of each vehicle on the traffic lane, and an image processor for obtaining vehicle information of the second vehicle from the number plate of the second vehicle photographed by the camera when the first detector judges the number of passing vehicles of the first vehicle as two vehicles and the second detector judges the number of passing vehicles of the first vehicle as one vehicle. The system compares the vehicle information obtained by the image processor with the vehicle information obtained by the antenna controller and recognizes the second vehicle of the first vehicle which is detected as two vehicles by the first detection means as a misread car when both types of information coincide with each other.

11 Claims, 6 Drawing Sheets

| No. | VEHICLE DETECTOR 21 | VEHICLE DETECTOR 22 | VEHICLE DETECTOR 23 | STATE OF SYSTEM CONTROL |
|---|---|---|---|---|
| ① | ONE VEHICLE | ONE VEHICLE | ONE VEHICLE | PASSING OF ONE VEHICLE |
| ② | ONE VEHICLE | ONE VEHICLE | TWO VEHICLES | PASSING OF ONE VEHICLE + MISREAD OF VEHICLE DETECTOR 23 |
| ③ | ONE VEHICLE | TWO VEHICLES | ONE VEHICLE | PASSING OF ONE VEHICLE + MISREAD OF VEHICLE DETECTOR 22 |
| ④ | ONE VEHICLE | TWO VEHICLES | TWO VEHICLES | PASSING OF ONE VEHICLE + MISREAD OF VEHICLE DETECTORS 22 & 23 |
| ⑤ | TWO VEHICLES | ONE VEHICLE | ONE VEHICLE | PASSING OF ONE VEHICLE + REMAINING OF ONE VEHICLE AFTER VEHICLE DETECTOR 21 |
| ⑥ | TWO VEHICLES | ONE VEHICLE | TWO VEHICLES | PASSING OF ONE VEHICLE + REMAINING OF ONE VEHICLE AFTER VEHICLE DETECTOR 21 + MISREAD OF VEHICLE DETECTOR 23 |
| ⑦ | TWO VEHICLES | TWO VEHICLES | ONE VEHICLE | PASSING OF ONE VEHICLE + REMAINING OF ONE VEHICLE AFTER VEHICLE DETECTOR 22 |
| ⑧ | TWO VEHICLES | TWO VEHICLES | TWO VEHICLES | PASSING OF TWO VEHICLES |

NOTE 1: In all cases, the number of vehicles is the number of detected vehicles when one vehicle passes.
NOTE 2: The vehicle detector which detects one vehicle detects the vehicle normally.
NOTE 3: The vehicle detector which detects two vehcles detects the vehicle separates and detects the vehicle.
NOTE 4: When a vehicle enters, the vehicle detector 21 always detects it and detection by the vehicle detectors 22 & 23 is invalid.

FIG. 5

TOLL COLLECTING SYSTEM AND METHOD INCLUDING DETERMINATION OF A TOWED VEHICLE

BACKGROUND OF THE INVENTION

1. Field of the Invention

The present invention relates to a toll collecting system and a toll collecting method applied to a toll road or others.

2. Description of the Related Art

Conventionally, in toll roads, a use toll collection system using magnetic transit cards, that is, a magnetic card system is introduced and operated. However, recently, an automatic toll collecting system using radio communication, a so-called ETC (electric toll collection) system has been studied.

Firstly, a magnetic card system using magnetic transit cards which is operated at present will be explained.

The magnetic card system reads entrance ramp magnetic information from a transit card on which entrance ramp information is magnetically written at an exit ramp toll booth and collects a charge on the basis of the information. The magnetic card system always issues one magnetic transit card for one vehicle.

At present, a magnetic transit card is issued by an automatic transit card issuer (hereinafter, called an automatic issuer) installed at an entrance ramp toll booth. On the vehicle entry side of the automatic issuer, a vehicle entry detector (or vehicle kind discriminator) is installed, which detects the vehicle entry state and allows the automatic issuer to issue a card.

Next, an ETC system whose future introduction is being studied will be explained.

The ETC system comprises a device on the vehicle side and devices on the traffic lane side. On the vehicle side, a vehicle mounting device (an IC card included) having a radio communication function is mounted. On the traffic lane side, a charge calculator having a radio communication function and various vehicle detectors are installed.

When a vehicle passes an entrance ramp toll booth of a toll road, the radio communication result is record on the IC card via the vehicle mounting device. When the vehicle passes an entrance ramp toll booth, the radio communication result is read as entrance ramp information from the IC card via the vehicle mounting device, and a charge is calculated by the charge calculator, and the result obtained by subtracting the charge is recorded on the IC card via the vehicle mounting device.

The ETC system is provided with a plurality of vehicle detectors on the traffic lane side and controls behavior of vehicles passing on the traffic lanes.

On the other hand, in an entrance ramp toll booth using the magnetic card system, when misreading of a vehicle detector (a vehicle separation phenomenon) occurs, mistaking of a card such that two transit cards are issued for one vehicle and the next vehicle receives the second transit card occurs.

For the mistaken transit card, although the name information of the entrance ramp toll booth (magnetic information and card print) is the same, there is the possibility that the vehicle kind may be interchanged. However, the exit ramp toll booth changes the vehicle kind and hence can surely receive the charge.

As mentioned above, the ETC system conceivable at present is structured so as to install a plurality of vehicle detectors on the traffic lane side where vehicles pass and control the vehicle moving state. However, vehicles using a toll road are of various kinds, for example, a vehicle connecting another vehicle behind it with a drawing roll such as a camping car and wrecking car.

On the other hand, the ETC system is intended to arrange many infrared sensors in each vehicle detector and detect vehicles as surely as possible. However, the system cannot correspond to vehicles of various connection kinds and even if many vehicle detectors are installed, there is the possibility that there may be a vehicle detector which can correctly detect one vehicle as one vehicle and a vehicle detector which cannot do it.

When all the vehicle detectors detect a vehicle similarly, it may be understood that the vehicle is detected correctly. However, when detection as one vehicle and separation and detection as two vehicles coexist, a misread vehicle may be considered to remain on the traffic lane. The misread vehicle indicates the back vehicle drown by the vehicle and from the viewpoint of system control, if the vehicle kind is decided by the front vehicle, there is no need to decide the kind of the drawing back vehicle. Actually, the system may misdecide that the back vehicle remains as one vehicle independent of the front vehicle.

When the next vehicle enters the traffic lane in this misdecision state, from the viewpoint of system control, a process of two vehicles including the remaining vehicle (misread vehicle) is generate. Actually, since there exists only the back vehicle on the traffic lane, a failure occurs in control of the order and behavior of vehicles and a great error may be caused in the system.

In the aforementioned conventional ETC system, to ascertain two vehicles and a drawing vehicle entering continuously on the traffic lane, a plurality of vehicle detectors are installed on the traffic lane. However, only such a vehicle separation measure is not sufficient and a problem arises that the system may misdecide a vehicle and its drawing vehicle as two vehicles and an error is caused in the system operation.

SUMMARY OF THE INVENTION

Although actually there is only one vehicle, even when a vehicle detector detects it as two vehicles by mistake, the present invention is intended to provide a toll collecting system and a toll collecting method which can operate the system normally without trouble.

According to the present invention, a toll collecting system is provided and the toll collecting system, comprises first detection means and second detection means which are sequentially arranged in a moving direction of vehicles passing on a traffic lane to receive toll for detecting a passing of a first vehicle and a second vehicle moving behind the first vehicle respectively; radio communication means for carrying out radio communication with the first vehicle passing on the traffic lane and with the second vehicle respectively and obtaining information such as a vehicle kind and a vehicle number; photographing means for taking a photograph of a number plate of each vehicle on the traffic lane; vehicle information obtaining means for obtaining vehicle information of the second vehicle from the number plate of the second vehicle photographed by the photographing means when the first detection means judges the number of passing vehicles of the first vehicle as two vehicles and the second detection means judges the number of passing vehicles of the first vehicle as one vehicle; and recognition means for comparing the vehicle information obtained by the vehicle information obtaining means with the vehicle information obtained by the radio communication means and recognizing the second vehicle of the first vehicle which is detected as two vehicles by the first detection means as a misread vehicle when both types of information coincide with each other.

Furthermore, according to the present invention, a toll collecting method for collecting toll from a vehicle passing on a traffic lane and permitting passing, the toll collecting method comprises a first communication step of carrying out radio communication with a first vehicle drawing a vehicle to be drawn passing on a traffic lane, obtaining information such as a vehicle kind and a vehicle number, and collecting a toll; a step of judging the vehicle drawn by the first vehicle as a vehicle different from the first vehicle; a stop step of stopping a subsequent vehicle so as to stop the drawn vehicle which is judged as a different vehicle from the first vehicle by the step of judging after the first vehicle drawing the vehicle to be drawn passes; a second communication step of carrying out radio communication with a second vehicle passing after the first vehicle, obtaining information such as a vehicle kind and a vehicle number, and collecting a toll; a photographing step of photographing a number plate of the second vehicle stopped at the stop step; a step of comparing the information obtained at the second communication step with the photographed number plate; and a step of permitting passing of the second vehicle when the vehicle whose number plate is photographed is the same vehicle as the second vehicle whose information is obtained at the second communication step on the basis of the comparison at the step of comparing.

BRIEF DESCRIPTION OF THE DRAWINGS

FIG. 5 is a table showing state judgment on the basis of detection results by vehicle detectors.

DETAILED DESCRIPTION OF THE PREFERRED EMBODIMENTS

The embodiments of the present invention will be explained in detail hereunder with reference to the accompanying drawings.

Figure 1:
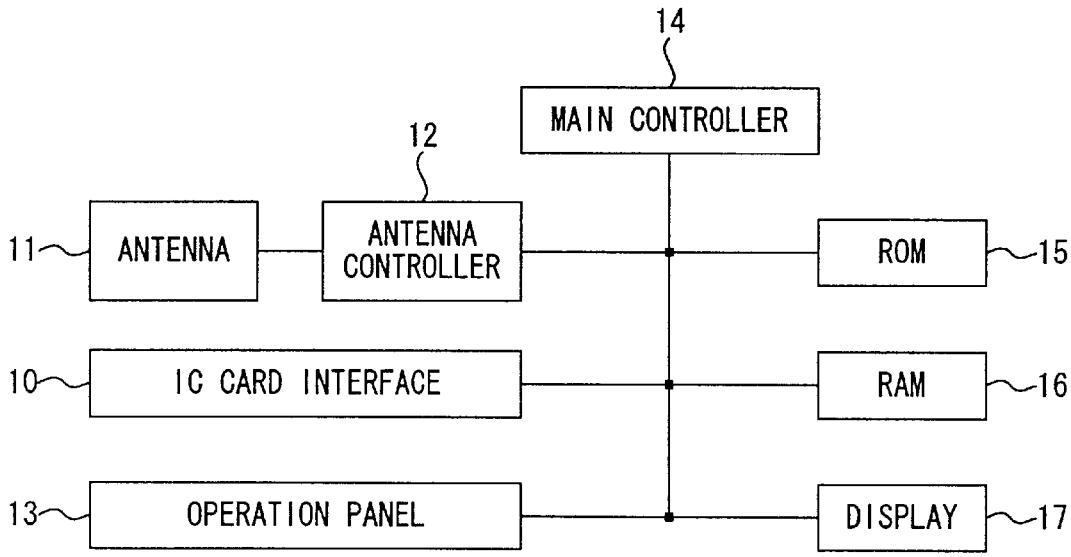
FIG. 1 is a block diagram showing the constitution of a vehicle mounting device applied to a toll collecting system of the present invention.
Figure 2:
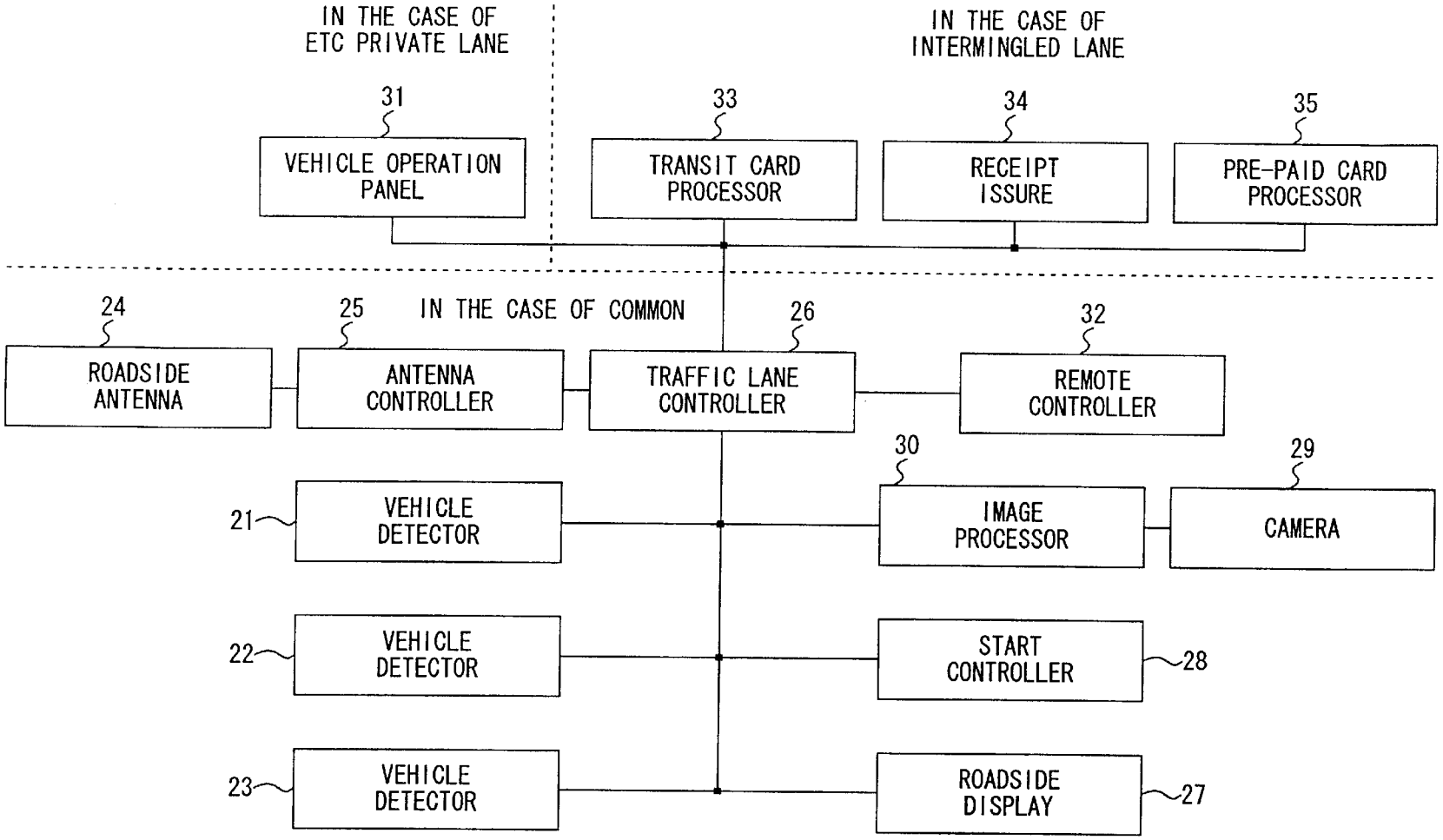
FIG. 2 is a block diagram showing the constitution of devices on the traffic lane side applied to a toll collecting system of the present invention.
Figure 3:
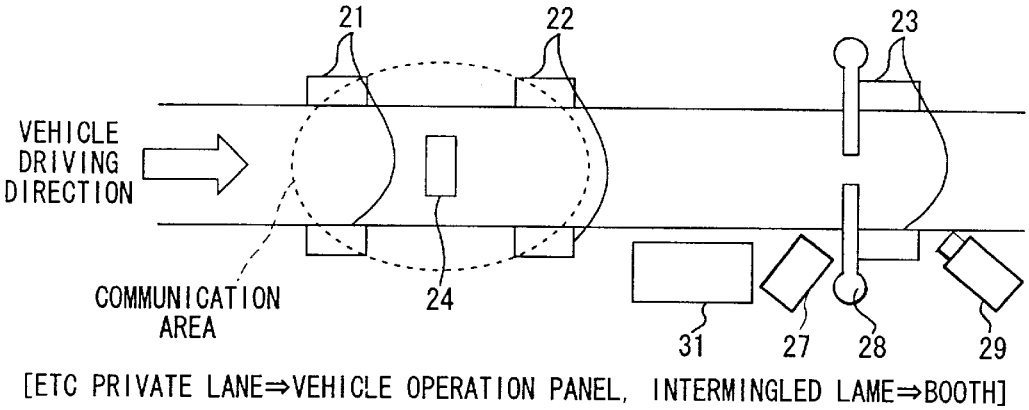
FIG. 3 is a schematic diagram showing arrangement of devices on the exit ramp traffic lane applied in a toll collecting system of the present invention.

FIG. 1 is a drawing showing the constitution of an ETC system which is an embodiment of a toll collecting system of the present invention, and FIG. 2 is a drawing showing the constitution of devices on the traffic lane side which are installed on the exit ramp traffic lane of an exit ramp toll booth of a toll road, and FIG. 3 is an arrangement drawing of devices on the exit ramp traffic lane.

Firstly, the device constitution of the ETC system introduced in a toll road will be explained.

The ETC system comprises a device on the vehicle side and devices on the traffic lane side. The device on the vehicle side is a vehicle mounting device which is mounted in a vehicle. The vehicle mounting device is provided with, as shown in FIG. 1, an IC card interface 10 which is a communication interface with an IC card, an antenna 11 for communicating with the devices on the traffic lane side, an antenna controller 12 for controlling the antenna 11, an operation panel 13 which is an interface with a user, a main controller 14 such as a CPU, storage devices such as a ROM 15 and a RAM 16, and a display 17. In the ROM 15, a program which is a radio communication function of the vehicle mounting device is stored and when the vehicle mounting device is started, the program is read by the main controller 14 and performs the operation as a vehicle mounting device. The RAM 16 is a working area for temporarily storing information read from the IC card and information to be written into the IC card. The C card interface 10 includes an IC card slot where the IC card is set. On the operation panel 13, a keying unit, a power ON/OFF button, and an IC card take-out button are provided.

The devices on the traffic lane side include, for example, in the case of an ETC private lane, as shown in FIG. 2, vehicle detectors 21, 22, and 23 as vehicle detection means, an antenna controller 25 for controlling a roadside antenna 24, a traffic lane controller 26, a roadside display 27, a start controller 28 as a vehicle control means, a camera 29 for taking a photograph of the number plate, an image processor 30, a vehicle operation panel 31 equipped with an operation means such as an interphone and a call button, and a remote controller 32. The roadside antenna 24 and the antenna controller 25 are referred to as a radio communication means. The traffic lane controller 26 is a control means for controlling each device and has a judgment state table for the vehicle detectors 21, 22, and 23, which will be described later, in its internal memory or hard disk unit. The traffic lane controller 26 judges vehicle separation using the judgment state table and reflects the judgment result on system control. The camera 29 and the image processor 30 are referred to as an image information obtaining means.

In addition, instead of the ETC private lane, on an intermingled lane of an ETC device and a manned processor, a booth is installed in place of the vehicle operation panel 31. In the booth, a transit card processor 33 having an operation panel equipped with an IC card reader and a misread vehicle exclusion button, a receipt issuer 34, and a pre-paid card processor 35 are installed. In the booth, a collecting person stands by and performs a toll collecting process by the aforementioned devices by transferring a card or cash from a driver of a passing vehicle. The remote controller 32 is installed in the control office and a misread vehicle exclusion button is provided. The remote controller 32 is operated by a remote control person (supervisor) in the control office. The misread vehicle exclusion button is referred to as an operation means. The exit ramp traffic lane of an exit ramp toll booth of a toll road is assumed to be an intermingled lane where an ETC device and a manned processor are intermingled so as to realize sharing of an existing magnetic card system.

Therefore, as shown in FIG. 3, in the case of an ETC private lane, the vehicle operation panel 31 for operation by a driver of a vehicle is installed, while in the case of an intermingled lane, a booth is installed. The vehicle detectors 21, 22, and 23 are, for example, an infrared sensor and a plurality of light emission units and a plurality of light receptors corresponding to them respectively are arranged opposite to each other across the traffic lane. The vehicle detector 21 is installed immediately before the roadside antenna 24 (in the vicinity of the front of the communication area) on the entry road to the traffic lane. The vehicle detector 22 is installed immediately after the roadside antenna 24 (in the vicinity of the back of the communication area) on the entry road to the traffic lane. The vehicle detector 23 is installed before the vehicle operation panel 31 or the booth on the traffic lane and in the vicinity of the exit before the start controller 28.

The camera 29 for taking a photograph of a number plate is installed in the roadside zone of the traffic lane so as to photograph the number plate of a vehicle which is prevented from passing by the start controller 28 when it is stopped. The vehicle operation panel 31 is installed in a position where a driver of the vehicle stopped by the start controller 28 can stretch out his hand from the window and press the button.

The roadside display 27 is installed in a position in the roadside zone of the traffic lane to which a driver of the vehicle stopped by the start controller 28 turns his eyes.

Next, a case that a misdecision of the vehicle detector (a vehicle separation phenomenon) is generated for one vehicle on the ETC private lane will be explained.

When one vehicle is separated and detected as two vehicles by the vehicle detectors 21, 22, and 23, a misread vehicle remains in the traffic lane by system control.

Generally, the three vehicle detectors 21, 22, and 23 are installed on one traffic lane and when one or more vehicle detectors of normal detection and one or more detectors of separation detection coexist among them, a separation phenomenon is generated.

Figure 4:
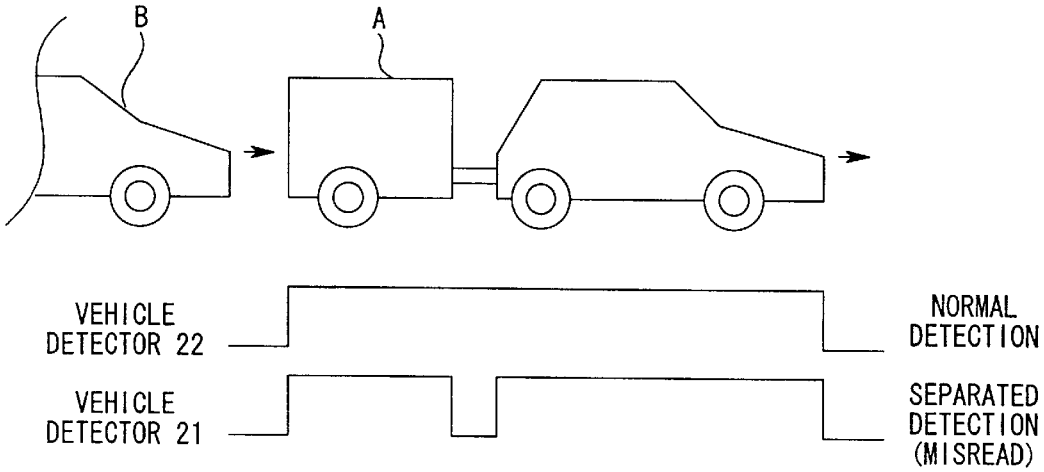
FIG. 4 is a schematic diagram showing a mechanism that a misread vehicle is generated by misread.

For example, when separation detection is generated only by the vehicle detectors, as shown in FIG. 4, when one vehicle enters from the entry side and although it is detected (separation, misread) as two vehicles by the first vehicle detector 21, it is detected as one vehicle by the second vehicle detector 22, the traffic lane controller 26 decides that one second vehicle (misread vehicle A) remains behind the vehicle detector 21. Misread of the number of vehicles by each of the vehicle detectors is easily caused by a difference in the speed of each vehicle passing in front of each vehicle detector and by a structure of a connection portion (the connection portion is thin, etc.).

When the succeeding vehicle B passes the vehicle detectors 21 and 22 in this misjudgment state, the traffic lane controller 26 judges that the remaining misread vehicle A starts and the succeeding vehicle B stops. In the actual moving state, the succeeding vehicle B just passes.

In this case, due to the remaining fictional misread vehicle A, the succeeding vehicles become out of order and a system error is caused. When vehicle separation is generated in all the vehicle detectors 21, 22, and 23, remaining of vehicles is not generated in the traffic lane, so that the subsequent system process will not be adversely affected.

Next, the judgment state table in the traffic lane controller 26 for each detection result of the vehicle detectors 21, 22, and 23 will be explained.

FIG. 5 shows a drawing showing the judgment state table in the traffic lane controller 26 and FIG. 6 shows drawings indicating the detection state of the vehicle detectors 21, 22, and 23.

As shown in FIG. 5, in a judgment state table 40, as states of vehicle detection by the vehicle detectors 21, 22, and 23, 8 kinds of states from No. ① to No. ⑧ are set.

Figure 6A:
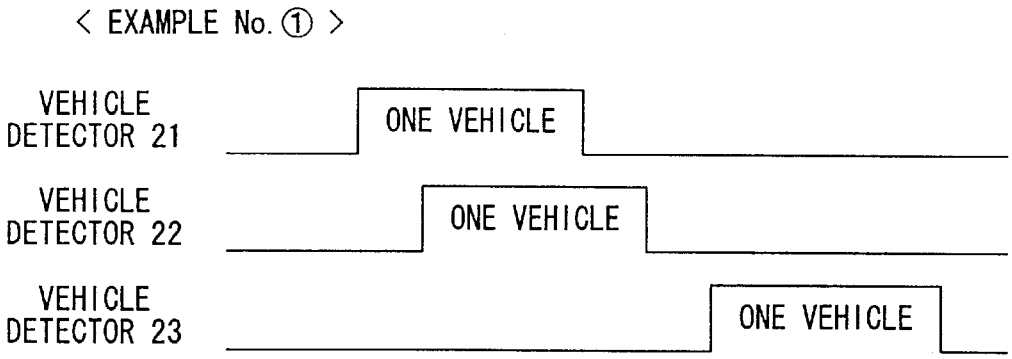
FIG. 6A is a chart showing a judgment example in the state of No. ① in the table shown in FIG. 5.

When all the vehicle detectors 21, 22, and 23 detect as one vehicle like the state of No. ① shown in FIG. 6A, the traffic lane controller 26 judges as passing of one vehicle.

On the other hand, when the vehicle detector 21 detects as one vehicle and any one of the vehicle detectors 22 and 23 detects as two vehicles like the states of Nos. ② and ③, the traffic lane controller 26 judges as "passing of one vehicle and misread of any one of the vehicle detectors 22 and 23". When the vehicle detector 21 detects as one vehicle and both the vehicle detectors 22 and 23 detect as two vehicles like the state of No. ④, the traffic lane controller 26 judges as "passing of one vehicle and misread of the vehicle detectors 22 and 23".

Figure 6B:
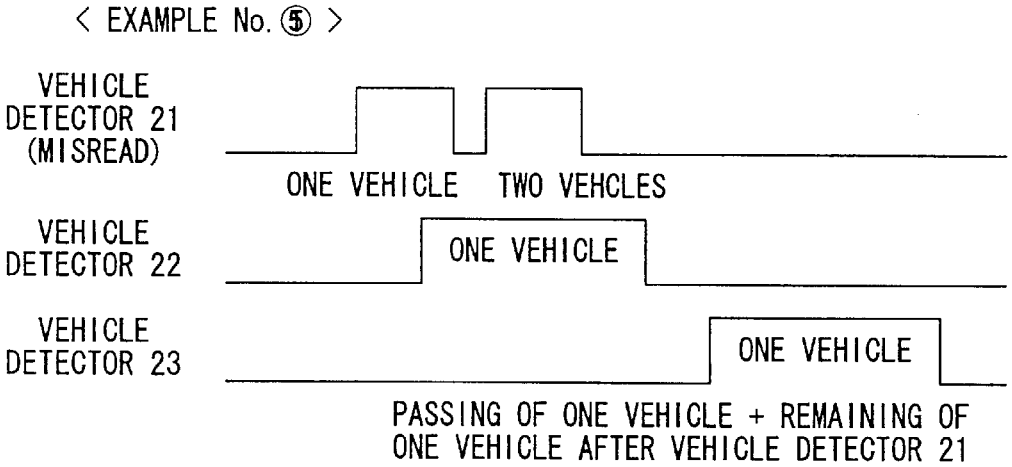
FIG. 6B is a chart showing a judgment example in the state of No. ⑤ in the table shown in FIG. 5.

When the vehicle detector 21 detects as two vehicles and both the vehicle detectors 22 and 23 detect as one vehicle like the state of No. ⑤ shown in FIG. 6B, the traffic lane controller 26 judges as "passing of one vehicle and remaining of one vehicle after the vehicle detector 21".

When the vehicle detector 21 detects as two vehicles, and the vehicle detector 22 detects as one vehicle, and the vehicle detector 23 detects as two vehicles like the state of No. ⑥, the traffic lane controller 26 judges as "passing of one vehicle, and remaining of one vehicle after the vehicle detector 21, and misread of the vehicle detector 23".

When the vehicle detector 21 detects as two vehicles, and the vehicle detector 22 detects as two vehicles, and the vehicle detector 23 detects as one vehicle like the state of No. ⑦, the traffic lane controller 26 judges as "passing of one vehicle and remaining of one vehicle after the vehicle detector 22".

When all the vehicle detectors 21, 22, and 23 detect as two vehicles like the state of No. ⑧, the traffic lane controller 26 judges as "passing of two vehicles".

The misread vehicle exclusion operation using the judgment state table 40 will be explained hereunder with reference to the states of Nos. ⑤ and ⑦.

As a vehicle in which a misread vehicle is easily generated, there is a connected vehicle (a vehicle having a drawing device (drawing vehicle) and a vehicle to be drawn) . A misread vehicle is considered to be often a vehicle to be drawn.

When the vehicle detector 21 (or the vehicle detector 22) judges the drawn vehicle as a second one by separating it from the drawing vehicle, the roadside antenna 24 carries out radio communication with the drawn vehicle on the basis of this decision standard.

However, since the drawn vehicle mounts no vehicle mounting device, it cannot communicate with the roadside antenna 24 (the traffic lane controller 26) and the traffic lane controller 26 handles it as an ETC processing error, allows the start controller (vehicle prevention means) 28 to perform the interruption operation immediately before the vehicle passes the ETC private lane, and controls the misread vehicle. In this case, on the roadside display 27, a message of "Processing error, press button." is displayed.

However, in the vehicle detector 23, the drawing vehicle and drawn vehicle are judged as one vehicle (a set) and pass the start controller 28, that is, the drawn vehicle passes this spot already together with the drawing vehicle and there is no vehicle actually. However, from the viewpoint of system control, the vehicle (the drawn vehicle) which is separated and detected by the vehicle detectors 21 and 22 and cannot carry out radio communication with the roadside antenna 24 remains as a misread vehicle in the traffic lane. From the viewpoint of system control, it is impossible to discriminate between a misread vehicle and a non-ETC vehicle.

Next, in the aforementioned state on the ETC private lane, a case that the second ETC vehicle enters the traffic lane will be explained.

When the next second ETC vehicle is detected by the vehicle detector 21 in the state that a misread vehicle remains in the traffic lane, the ETC exit ramp process (the toll collecting process by radio communication) is started by the traffic lane controller 26 and after this process terminates normally, the second ETC vehicle passes the vehicle detector 22.

The second ETC vehicle ascertains the control of the start controller 28 and the display ("Processing error, press button.") of the roadside display 27 and stops. This state is generated by remaining of the misread vehicle which is the previous vehicle and the second ETC vehicle terminates normally already.

Figure 7:
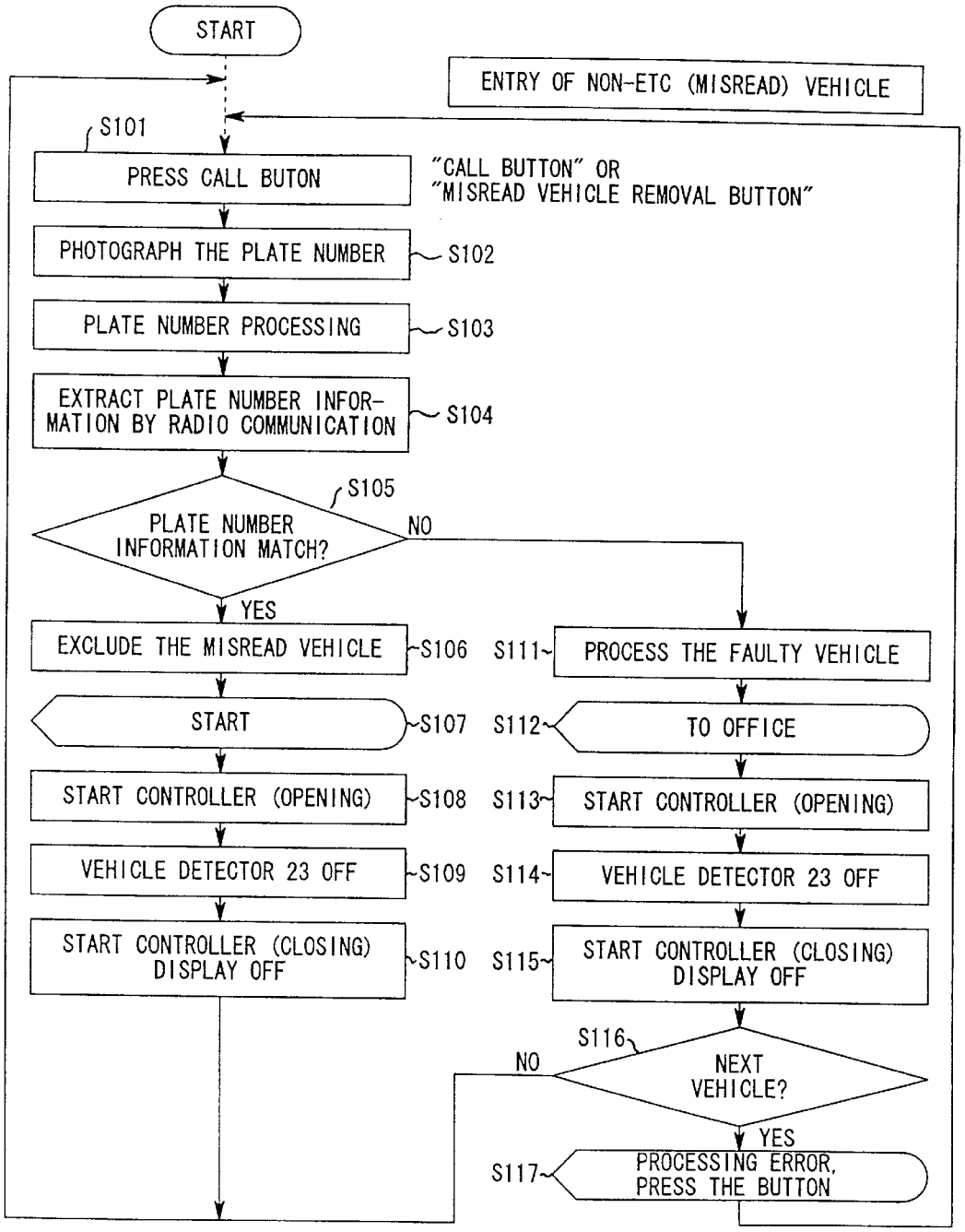
FIG. 7 is a flow chart showing the operation when a misread vehicle is generated.

In this case, as shown in FIG. 7, when a driver of the second ETC vehicle presses the "call button" of the vehicle operation panel 31 installed on the road side according to the instruction of the display (S101), the traffic lane controller 26 allows the camera 29 to perform the photographing operation using it as a trigger. By doing this, the number plate of the second ETC vehicle which is stopped is photographed by the camera 29 (S102) and the image data of the photographed number plate is transferred to the image processor 30. The image processor 30 image-processes the transferred image data of the number plate (S103), extracts the number information, and sends it to the traffic lane controller 26.

The traffic lane controller 26 fetches the number information obtained by radio communication with the second ETC vehicle and compares it with the number information sent from the image processor 30. The number information obtained by radio communication is, in this case, the information obtained by the ETC process with the second ETC vehicle, though when a plurality of ETC vehicles range in the traffic lane, the traffic lane controller 26 extracts information of the top vehicle among the ETC vehicles. Since the misread vehicle is a vehicle which does not exist actually, when the number plate is actually photographed at the stop position, the number plate of the second ETC vehicle stopped is photographed.

When a match is found in the comparison of the number information (YES at S105), the traffic lane controller 26 judges that the vehicle stopped in front of the start controller 28 is the second ETC vehicle for which the ETC process is performed and the vehicle existing in front of the second ETC vehicle for which the ETC process is performed is a misread vehicle and excludes it from the system process (S106).

Namely, the traffic lane controller 26 corrects the judgment of vehicle existence (misread vehicle) from the detection results of the vehicle detectors 21, 22, and 23.

Since the second ETC vehicle is subjected to the ETC process already when it enters, the traffic lane controller 26 allows the roadside display 27 to display "Start" (S107), the start controller 28 to perform the opening operation (S108), and the second ETC vehicle to pass.

Thereafter, the traffic lane controller 26 turns the vehicle detector 23 OFF (S109) and allows the start controller 28 to perform the closing operation and also the roadside display 27 to turn the display off (S110).

By this series of processing, the exclusion of misread vehicles and toll collection of ETC vehicles can be executed without disturbing the order of vehicles.

Next, a case that when a misread vehicle remains on the ETC private lane, the next vehicle, for example, a non-ETC vehicle or an ETC error vehicle enters will be explained. A non-ETC vehicle is a vehicle mounting no vehicle mounting device and an ETC error vehicle is a vehicle that although it mounts a vehicle mounting device, it abnormally terminates during the ETC process.

When a misread vehicle remains and for example, a non-ETC vehicle enters, the non-ETC vehicle is stopped in front of the start controller 28 by the display in the same way as with the aforementioned. This state is caused by remaining of the misread vehicle and the non-ETC vehicle is in the state that the toll collecting process is not performed.

In this case, when a driver of the vehicle presses the "call button" of the vehicle operation panel 31 installed on the road side according to the instruction of the display (S101), the traffic lane controller 26 allows the camera 29 to perform the photographing operation using it as a trigger. By doing this, the number plate of the non-ETC vehicle stopped is photographed by the camera 29 (S102) and the image data of the photographed number plate is transferred to the image processor 30. The image processor 30 image-processes the transferred image data of the number plate (S103), extracts the number information, and sends it to the traffic lane controller 26.

Since the traffic lane controller 26 cannot obtain number information by radio communication with the non-ETC vehicle, error information results in this case. When the traffic lane controller 26 compares the number information sent from the image processor 30 with the error information, a mismatch is found. Even in this case, the misread vehicle is a vehicle which does not exist actually, so that when the number plate is actually photographed at the stop position, the number plate of the non-ETC vehicle stopped is photographed.

When a mismatch is found in the comparison of the number information (NO at S105), the traffic lane controller 26 judges it as a comparison result error because no information can be obtained by communication, leads the vehicle to the office, and performs the faulty vehicle process (S111, S112). The leading is performed by an interphone built in the vehicle operation panel 31 and the roadside display 27. However, the vehicle for which this special faulty vehicle process is to be executed is the top vehicle and the order of vehicles is disturbed by remaining of the misread vehicle.

After leading the vehicle to the office, the traffic lane controller 26 allows the start controller 28 to perform the opening operation (S113), turns the vehicle detector 23 OFF (S114), allows the start controller 28 to perform the closing operation, and also the roadside display 27 to turn the display off (S115).

This special faulty vehicle process is performed until the misread vehicle is excluded due to entry of a new ETC vehicle (S116, S117).

Next, the remote control will be explained.

When an ETC processing error is displayed on the traffic lane supervisory monitor of the remote controller 32 installed in the control office even if no vehicle remains in the traffic lane, if a remote control person for monitoring the traffic lane conditions in the control office ascertains the image taken by the supervisory camera on the monitor, he can clearly judge it as a misread vehicle.

In this case, he can press the misread vehicle exclusion button provided in the remote controller 32, inform the traffic lane controller 26 of exclusion of the misread vehicle, and allow the traffic lane controller 26 to forcibly exclude the misread vehicle.

Next, a case that the exit traffic lane is an intermingled lane will be explained.

When the exit traffic lane is an intermingled lane, there is a collecting person in the booth and the processing state of each vehicle is displayed on the operation panel of the transit card processor 33. There are display examples such as "ETC process normal" or "ETC process abnormal" available in correspondence with each vehicle.

When the ETC process is abnormal, the toll collection process (special process) is performed by the collecting person and the office.

When the start controller 28 is kept closed though the ETC process is normal, it may be considered that a misread vehicle remains. If this occurs, the collecting person presses the "misread vehicle confirmation button" on the operation panel of the transit card processor 33.

Then, using it as a trigger, the traffic lane controller 26 allows the camera 29 to perform the photographing operation and take a photograph of the number plate of the vehicle stopped at the position. The information comparison process thereafter is the same as the aforementioned one. When an ETC process error is displayed on the operation panel though no vehicle remains in the traffic lane, a remaining vehicle of a misread vehicle is generated clearly. If this occurs, when the collecting person presses the "misread vehicle exclusion button", remaining of the misread vehicle is excluded.

As mentioned above, according to the ETC system of this embodiment, when a misread vehicle is detected, to exclude it, the camera 29 is installed in the neighborhood of the start controller 28 and number information is obtained by the image processor. The obtained number information and the number information obtained by radio communication are compared. When a match occurs in the comparison result, the traffic lane controller 26 judges it as a misread vehicle and excludes the vehicle which ought to exist from the viewpoint of the system as a misread vehicle and hence the subsequent vehicles can be processed surely and normally.

In the intermingled lane of the ETC device and manned processor, on the operation panel of the transit card processor 33 operated by a collecting person, a misread vehicle exclusion button is installed. In the ETC private lane, on the remote controller 32 operated by a remote control person, a misread vehicle exclusion button is installed. Therefore, when the collecting person or remote control person ascertains clearly as a misread vehicle (even if no vehicle remains in the traffic lane, an ETC processing error is displayed) and presses the misread vehicle exclusion button, the vehicle which ought to exist from the viewpoint of the system is excluded as a misread vehicle from the system and hence the subsequent vehicles can be processed surely and normally.

As explained above, according to the present invention, the toll collecting system detects a vehicle passing on the traffic lane for collecting a charge, separates and judges the vehicle as one vehicle or two vehicles on the basis of the detection result, when the vehicle is detected, obtains vehicle information by performing radio communication with the vehicle, and when the vehicle is judged to be separated into two vehicles, obtains vehicle information by photographing the back vehicle. The toll collecting system separates and judges the vehicle from the obtained vehicle information and the vehicle information obtained by radio communication and reflects the judgment result on system control, and hence a vehicle can be separated and judged surely.

What is claimed is:

1. A toll collecting system, comprising:

first detection means and second detection means which are sequentially arranged in a moving direction of vehicles passing on a traffic lane to collect a toll for detecting a passing of a first vehicle and a second vehicle moving behind the first vehicle respectively;

radio communication means for carrying out radio communication with the first vehicle passing on the traffic lane and with the second vehicle respectively and obtaining information such as a vehicle kind and a vehicle number;

photographing means for taking a photograph of a number plate of each vehicle on the traffic lane;

vehicle information obtaining means for obtaining vehicle information of the second vehicle from the number plate of the second vehicle photographed by the photographing means when the first detection means judges the number of passing vehicles of the first vehicle as two vehicles and the second detection means judges the number of passing vehicles of the first vehicle as one vehicle; and recognition means for comparing the vehicle information obtained by the vehicle information obtaining means with the vehicle information obtained by the radio communication means and recognizing the second vehicle of the first vehicle which is detected as two vehicles by the first detection means as a misread vehicle when both types of information coincide with each other.

2. A toll collecting system according to claim 1, further comprising:

correction means for excluding the misread vehicle's data from a toll collecting object when the recognition means recognizes the misread vehicle.

3. A toll collecting system according to claim 1, further comprising:

transit permission means for permitting passing of the second vehicle when the recognition means recognizes the misread vehicle.

4. A toll collecting method for collecting a toll from a vehicle, comprising the steps of:

carrying out radio communication with a first vehicle drawing another vehicle to be drawn passing on a traffic lane, obtaining information such as a vehicle kind and a vehicle number, and collecting a toll;

judging the another vehicle drawn by the first vehicle as a vehicle different from the first vehicle;

stopping a subsequent vehicle moving behind the first vehicle so as to stop the another vehicle which is judged as a different vehicle from the first vehicle by the step of judging after the first vehicle drawing the another vehicle passed;

carrying out radio communication with a second vehicle passing after the first vehicle, obtaining information such as a vehicle kind and a vehicle number, and collecting a toll;

photographing a number plate of the second vehicle stopped by the stopping step;

comparing the information obtained from the second vehicle with the photographed number plate; and permitting passing of the second vehicle when the vehicle whose number plate is photographed is the same vehicle as the second vehicle whose information is obtained from the second vehicle on the basis of the comparison at the comparing step.

5. A toll collecting method according to claim 4, further comprising:

an instruction step of instructing execution of the photographing step.

6. A toll collecting system, comprising:

first detection means and second detection means which are sequentially arranged in a moving direction of vehicles passing on a traffic lane to collect a toll for detecting a passing of a first vehicle and a second vehicle moving behind the first vehicle respectively;

radio communication means for carrying out radio communication with the first vehicle passing on the traffic lane and with the second vehicle respectively and obtaining information such as a vehicle kind and a vehicle number;

vehicle restraining means for restraining the second vehicle when the first detection means judges the number of passing vehicles of the first vehicle as two vehicles and the second detection means judges the number of passing vehicles of the first vehicle as one vehicle;

vehicle information obtaining means for photographing a number plate of the restrained second vehicle and obtaining vehicle information of the second vehicle from the number plate; and recognition means for comparing the vehicle information obtained by the vehicle information obtaining means with the vehicle information obtained by the radio communication means and recognizing the second vehicle of the first vehicle which is detected as two vehicles by the first detection means as a misread vehicle when both types of information coincide with each other.

7. A toll collecting system according to claim 6, further comprising:

correction means for removing the misread vehicle from a toll collecting object when the recognition means recognizes the misread vehicle.

8. A toll collecting system according to claim 6, further comprising:

transit permission means for permitting passing of the second vehicle when the recognition means recognizes the misread vehicle.

9. A toll collecting system, comprising:

first detection means and second detection means which are sequentially arranged in a moving direction of vehicles passing on a traffic lane to collect a toll for detecting a passing of a first vehicle and a second vehicle moving behind the first vehicle respectively;

radio communication means for carrying out radio communication with the first vehicle passing on the traffic lane and with the second vehicle respectively and obtaining information such as a vehicle kind and a vehicle number;

vehicle restraining means for restraining the second vehicle when the first detection means judges the number of passing vehicles of the first vehicle as two vehicles and the second detection means judges the number of passing vehicles of the first vehicle as one vehicle;

vehicle information obtaining means for photographing a number plate of the restrained second vehicle and obtaining vehicle information of the second vehicle from the number plate; and leading means for comparing the vehicle information obtained by the vehicle information obtaining means with the vehicle information obtained by the radio communication means and leading the second vehicle restrained by the vehicle restraining means to a predetermined place when both types of information do not coincide with each other.

10. A toll collecting system, comprising:

first detection means and second detection means which are sequentially arranged in a moving direction of vehicles passing on a traffic lane to collect a toll for detecting a passing of a first vehicle and a second vehicle moving behind the first vehicle respectively;

toll collecting means for collecting a toll from the first and second vehicles passing on the traffic lane;

photographing means for taking a photograph of a number plate of each vehicle on the traffic lane;

vehicle information obtaining means for obtaining vehicle information of the second vehicle from the number plate of the second vehicle photographed by the photographing means when the first detection means judges the number of passing vehicles of the first vehicle as two vehicles and the second detection means judges the number of passing vehicles of the first vehicle as one vehicle; and recognition means for comparing the vehicle information obtained by the vehicle information obtaining means with the vehicle which is collected the toll by the toll collecting means and recognizing the second vehicle of the first vehicle which is detected as two vehicles by the first detection means as a misread vehicle when both types of information coincide with each other.

11. A toll collecting system according to claim 10, further comprising:

means for restraining the second vehicle when the first detection means judges the number of passing vehicles of the first vehicle as two vehicles and the second detection means judges the number of passing vehicles of the first vehicle as one vehicle; and wherein the photographing means takes the photograph of the second vehicle restrained by the restraining means.

* * * * *